US006139716A

United States Patent [19]

McCarthy et al.

[11] Patent Number: 6,139,716

[45] Date of Patent: Oct. 31, 2000

[54] SUBMICRON PATTERNED METAL HOLE ETCHING

[75] Inventors: Anthony M. McCarthy, Menlo Park, Calif.; Robert J. Contolini, Lake Oswego, Oreg.; Vladimir Liberman, Needham, Mass.; Jeffrey Morse, Martinez, Calif.

[73] Assignee: The Regents of the University of California, Oakland, Calif.

[21] Appl. No.: 09/315,387

[22] Filed: May 18, 1999

[51] Int. Cl.[7] ..... C25F 3/12

[52] U.S. Cl. ..... 205/665; 205/666

[58] Field of Search ..... 205/665, 666

[56] References Cited

U.S. PATENT DOCUMENTS

| | | | |
|---|---|---|---|
| 3,678,348 | 7/1972 | Reber et al. | 317/235 |
| 5,071,510 | 12/1991 | Findler et al. | 156/647 |
| 5,139,624 | 8/1992 | Searson et al. | 204/129.3 |
| 5,501,787 | 3/1996 | Bassous et al. | 205/124 |

*Primary Examiner*—Kathryn Gorgos
*Assistant Examiner*—Thomas H. Parsons
*Attorney, Agent, or Firm*—Daryl S. Grzybicki; L. E. Carnahan; Alan H. Thompson

[57] ABSTRACT

A wet chemical process for etching submicron patterned holes in thin metal layers using electrochemical etching with the aid of a wetting agent. In this process, the processed wafer to be etched is immersed in a wetting agent, such as methanol, for a few seconds prior to inserting the processed wafer into an electrochemical etching setup, with the wafer maintained horizontal during transfer to maintain a film of methanol covering the patterned areas. The electrochemical etching setup includes a tube which seals the edges of the wafer preventing loss of the methanol. An electrolyte composed of 4:1 water: sulfuric is poured into the tube and the electrolyte replaces the wetting agent in the patterned holes. A working electrode is attached to a metal layer of the wafer, with reference and counter electrodes inserted in the electrolyte with all electrodes connected to a potentiostat. A single pulse on the counter electrode, such as a 100 ms pulse at +10.2 volts, is used to excite the electrochemical circuit and perform the etch. The process produces uniform etching of the patterned holes in the metal layers, such as chromium and molybdenum of the wafer without adversely effecting the patterned mask.

27 Claims, 1 Drawing Sheet

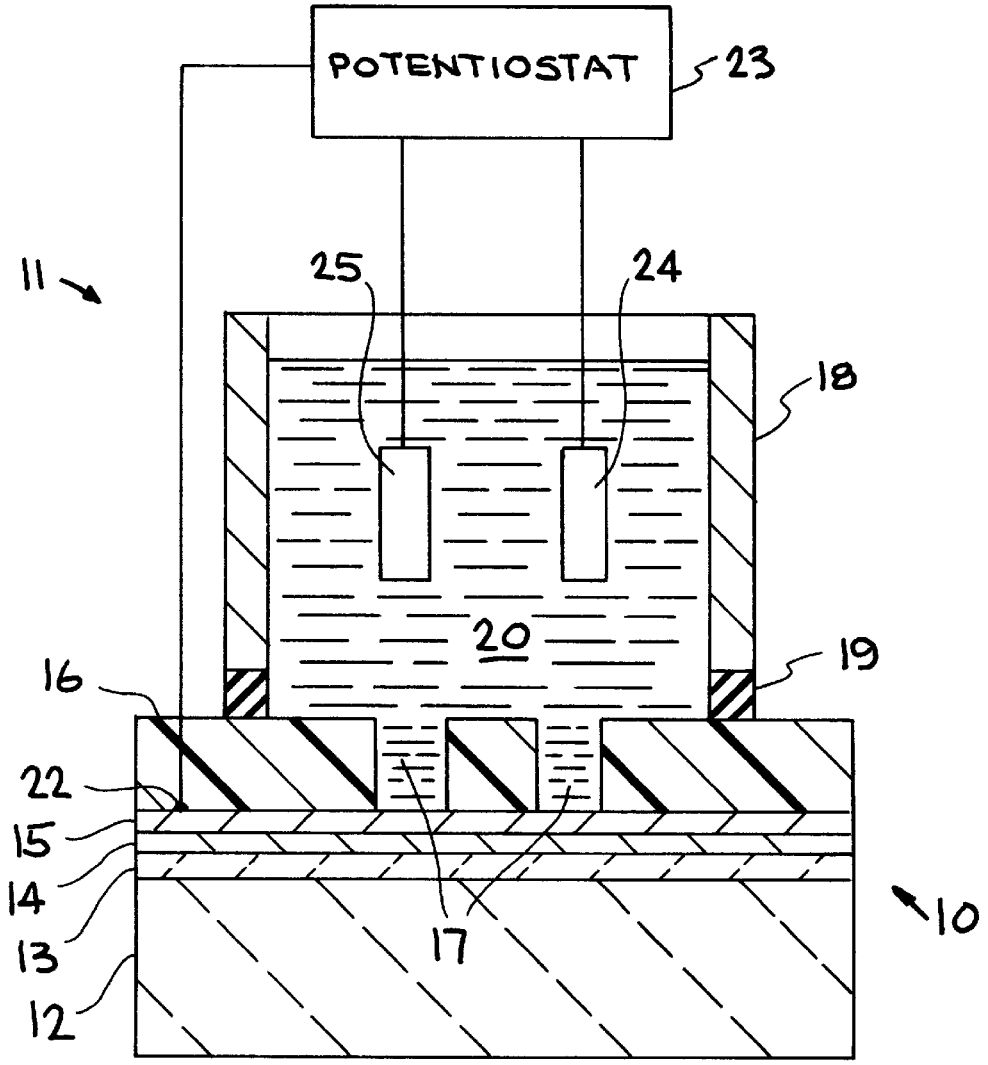
POTENTIOSTAT
23
11
25
24
18
20
19
16
22
15
14
13
12
17
10

SUBMICRON PATTERNED METAL HOLE ETCHING

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention is related to etching holes in metal, particularly to etching submicron patterned holes in thin metal layers, and more particularly to electrochemical etching of submicron patterned holes in thin metal layers with the aid of a wetting agent.

2. Description of the Related Art

During the past decade, substantial research and development has been directed to fabrication of devices such as field emitters for flat panel displays, which involve the formation and etching of holes in various materials. In a number of these fabrication approaches, nuclear tracking has been utilized to form initial tracks in a mask material, after which the tracks would be etched by various techniques to form holes in one or more layers of material under the mask material.

It has long been recognized that the etching of submicron patterned holes in thin metal layers is difficult due to geometry limitations, the short duration of the mask life during etching, the adhesion of the mask to the surface of the metals, and the inability of chemical etches to wet the masking material. In the prior art, plasma etching has been used to perform the transfer process but this requires sophisticated and expensive equipment. For field emission display (FED) applications, for example, or other applications requiring submicron features patterned in metal films, the masking material is generally polycarbonate, such as LEXAN manufactured by General Electric Corporation. The LEXAN is spun on the wafers which have had a sequence of thin films deposited to form the cathode or row electrical contact, the intermetal dielectric (IMD), and the gate electrode metal. For example, the cathode is a silicon substrate, the IMD is a silicon dioxide, and the gate metal is titanium/molybdenum/chromium, with the titanium used for adhesion to the silicon dioxide surface, and the chromium used to promote the stick of LEXAN to the surface of the gate metal. For field emission display applications the cathode is a patterned row metalization, the IMD is a deposited silicon dioxide, and the gate metals could be reduced to a single metal film, such as molybdenum, chromium, or others, with a thickness on the order of 200–1000 Å. After the LEXAN is spun on the processed wafer, it is baked to prepare the masking material. Practical embodiments for field emission display applications may also include a highly resistive thin film between the row metal and insulating IMD to provide resistive current limiting to any emitters exhibiting excessive field emission currents.

Holes are formed in the mask, such as LEXAN, by nuclear tracking, by implanting a low density of MeV heavy ions, such as xenon or krypton, through the mask material followed by wet etching of the nuclear tracked regions with high selectivity over the non-tracked regions. The trackable material or mask is not limited to polycarbonate or LEXAN, which exhibits the highest selectivity, but could include polyimides, polymethylmethacrylate (PMMA), or standard positive photoresists. Using a LEXAN film having etched tracks as a mask layer to transfer the patterns to the gate metal, a wafer exposed to a chlorine plasma environment both etches the patterned holes in the chromium and simultaneously removes the LEXAN. In such an embodiment, as described above, the chromium, which is only 100–200 Å thick, is used as a masking material for plasma etching the molybdenum with $SF_6$ or $CF_4$ chemistries, after which the oxide (silicon dioxide) layer is plasma etched with $CHF_3$ and $O_2$ chemistry using the chromium and/or molybdenum thin layer as a mask. Field emission devices can then be formed by known techniques to form a self-aligned, gate nanofilament.

The principle problem with the prior known plasma etching scheme is the short duration of the LEXAN mask and the expensive plasma generation and vacuum pumping equipment used to perform the etch. Conventional wet chemical etching of the metal is avoided since over-etching ruins the physical structure of the hole in the metal being etched, and since conventional metal etches do not wet the LEXAN, thereby limiting both the control and uniformity for etching the structures in the gate metal.

The present invention provides a solution to the above-referenced prior art etching techniques, by providing a wet chemical process for etching submicron patterned holes in thin metal layers using electrochemical etching with the aid of a wetting agent. Basically, the process of the invention involves immersing the processed wafer in a wetting agent, and then transferring the wetted wafer to an electrochemical etching apparatus, wherein the wetting agent in the masking layer tracks is replaced by an electrolyte, after which the metal patterns exposed at the bottom of the tracks are etched by an electrochemical process, producing uniform etching of patterned holes in both the chromium and the molybdenum thin layers, utilizing the patterned LEXAN as a mask.

SUMMARY OF THE INVENTION

It is an object of the present invention to provide a process and apparatus for etching submicron patterned holes in a metal.

A further object of the invention is to provide a process and apparatus for submicron metal hole etching which overcomes the prior problems of introducing the etching agent into the patterned tracks, and also eliminates the need for expensive plasma etching.

Another object of the invention is to provide a wet chemical process for etching submicron patterned holes in thin metal layers using electrochemical etching with the aid of a wetting agent.

Another object of the invention is to provide a process for etching holes in a mask, and utilizing the etched holes as a mask during etching of one or more metal layers beneath the mask.

Another object of the invention is to provide a process for etching patterned holes in one or more thin metal layers which involves immersing the patterned samples in a wetting agent to at least partially fill the tracks in a mask, transferring the wetted samples to an electrochemical etching apparatus while maintaining the wetting agent in the tracks, exchanging the wetting agent with an electrolyte, and electrochemically etching holes in the mask and the metal layers using the patterned holes in the masking material.

Other objects and advantages of the present invention will become apparent from the following description and accompanying drawing. The present invention involves a process and apparatus for submicron patterned metal hole etching. The process involves immersing the processed wafer containing at least one metal layer in a wetting agent to enable wetting of the patterned tracks formed in a mask, an electrochemical etching of the tracks in the wetted patterned mask and forming patterned holes in the metal layer or layers beneath the mask, wherein the wetting agent in the tracks of the mask is replaced by the electrolyte of the electrochemical etching apparatus. The apparatus includes a movable tube which both prevents loss of the wetting agent and defines a container for the electrolyte, and includes a working electrode to be connected to a metal layer of the processed wafer, with counter and reference electrodes placed in the electrolyte, each of the three electrodes being connected to a potentiostat.

BRIEF DESCRIPTION OF THE DRAWING

The accompanying drawing which is incorporated into and forms a part of the disclosure, illustrates an embodiment of the apparatus of the invention and, together with the description, serves to explain the principles of the invention.

The single FIGURE, shown in cross-section, schematically illustrates an embodiment of an electrochemical etching apparatus for etching submicron holes in one or more metal layers of a processed silicon wafer, such as may be utilized in field emission devices.

DETAILED DESCRIPTION OF THE INVENTION

The present invention is directed to submicron patterned metal hole etching, particularly to a process and apparatus which overcomes the difficulty of etching submicron patterned holes in thin metal layers due to the geometry limitations, the short duration of mask life during etching, and the inability of chemical etches to wet the masking material, as well as eliminating the sophisticated and expensive equipment required for plasma etching to perform the transfer process to the metal layer or layers. The present invention is a wet chemical process using electrochemical etching with the aid of a wetting agent.

The process and apparatus for carrying out the process is described hereinafter for etching holes in thin layers of chromium and molybdenum which are deposited on a silicon substrate over a silicon dioxide inter-metal dielectric layer. A masking layer of LEXAN is formed on the top metal layer, and is subjected to a nuclear (heavy ion) tracking technique as known in the art to form patterned tracks in the LEXAN.

As shown in the single figure a process wafer generally indicated at 10 is electrochemically etched by an apparatus generally indicated 11. The illustrated embodiment of the wafer 10 comprises a silicon substrate 12, a layer of silicon dioxide 13, a layer of 14 of molybdenum, a layer 15 of chromium, and a LEXAN layer or mask 16 which has been ion implanted to form tracks or holes 17 therethrough. As pointed out above, a titanium layer, for example, not shown, may be utilized as an adhesion layer between the molybdenum layer 14 and the silicon dioxide layer 13, and, for example, only one metal layer, such as layer 14 may be utilized, as the chromium layer 15 can be omitted if the mask layer 16 has good adhesion with the upper metal layer, in which case the metal layer 14 may be composed of molybdenum, nickel, copper, silver, tungsten, or chromium, for example. While the mask layer 16 of LEXAN is preferable, masks layers composed of polycarbonate, polyimides, PMMA, and photoresists may be utilized. The tracks or holes 17 may be made in the LEXAN 16 by implanting a low density (of the order of $10/cm^2$ to about $10^8 cm^2$) of MeV Xenon, krypton, or other heavy ion metals, as known in the art of nuclear track formation techniques. The tracks are delineated by selective etching of the tracked material, for example, a low concentration alkaline solution of potassium hydroxide (KOH) of pH 8–11.

The embodiment of the etching apparatus 11 comprises a hollow member or tube 18 having a gasket or seal 19 which abuts the surface of the LEXAN layer 16, and contains an electrolyte 20. A working electrode 21 is connected as indicated at 22 to chromium layer 15 and to a potentiostat 23. A reference electrode 24 and a counter electrode 25 are immersed in electrolyte 20 and connected to a controlled electric power source, such as polentiostat 23. By way of example, the reference electrode 24 may be composed of saturated-calomel, and the counter electrode 25 may be composed of gold or a metal not soluble in the electrolyte, with the electrolyte 20 being composed of 4:1 water: sulfuric, or an electrolyte suitable for the selected metal layers, for example 5% NaOH is suitable for tungsten and 15% $HNO_3$ is suitable for silver, both with a stainless steel counter electrode. For example a +10.2 volt, 100 ms single pulse on the counter electrode may be used to excite the electrochemical circuit and perform the etch. A voltage range of 1–20 V and pulse times of 1 ms–1 second may be used.

The sequential operational steps of the process of the present invention, is exemplified as follows:

1. Provide a processed wafer, having the correct sequence of dielectric and metal layers disposed on it, with a mask of LEXAN which has a patterned track region therein.
2. Immerse the processed wafer with 10 in a wetting agent, such as methanol, ethanol, and trichloroethyline, or isopropanol, for a few seconds (10 to 60 seconds) depending on the composition of the masking layer 16 and the etchant or electrolyte 20 of the electrochemical etching apparatus 11.
3. Transfer the immersed, processed wafer 10 to the electrochemical etching apparatus 11 so that the wafer is maintained horizontal to maintain a film of the wetting agent covering the patterned area.
4. Position the gasket or seal 19 of the hollow member or tube 18 of apparatus 11 on the wafer 10, thereby sealing the edges of the wafer 10 preventing the wetting agent from being lost.
5. Pour the electrolyte 20 into the tube 18, the electrolyte being, for example, 4:1 water: sulfuric. The dilute sulfuric acid solution replaces the wetting agent in the tracks or holes 17, achieving the first goal of providing the chemical agent in the tracks or holes 17 of the LEXAN layer of mask 16.
6. Connect the working electrode 21 from the polentiostat 23 to the outer metal layer 15.
7. Insert the reference electrode 24 such as composed of saturated-calomel, and the counter electrode 25, such as composed of gold, in the electrolyte 20 in a spaced relationship, whereby, the electrochemical circuit is established.
8. Apply a +10.2 V, 100 ms single pulse, for example, on the counter electrode 25 which excites the electrochemical circuit and performs the etch of the holes 17 in the LEXAN mask 16, and forms uniform aligned holes (not shown) in the metal layers 14 and 15.

It has thus been shown that the present invention provides a process and apparatus for etching submicron holes in thin metal layers, and overcomes the prior problems which were due to geometry limitations, the short duration of mask life during etching, and the inability of chemical etches to wet the masking material, as well as eliminating the sophisticated and expensive equipment required for plasma etching. Thus, by use of electrochemical etching with the aid of a wetting agent, the present invention has provided a significant advance in the art of submicron patterned metal hole etching.

While a particular sequence of operation steps, a particular embodiment of an apparatus, along with specified materials and parameters have been set forth to exemplify and teach the principles of the invention, such are not intended to be limiting. Modifications and changes may become apparent to those skilled in the art. It is intended that the invention be limited only by the scope of the appended claims.

What is claimed is:

1. A process for forming submicron holes in thin metal layers comprising:

providing a device having at least one thin metal layer with a masking layer thereon, providing at least one patterned hole of a patterned area in said masking layer by low density ion implantation followed by selective etching of the at least one patterned hole, immersing the device in a wetting agent, immersing the wetted device in an electrolyte such that the electrolyte replaces the wetting agent in the patterned hole of the at least one patterned area, and exciting an electrochemical reaction causing etching of the at least one patterned hole in the at least one thin metal layer.

2. The process of claim 1, additionally including transferring the wetted device to the electrolyte in an electrochemical etching apparatus such that a film of the wetting agent is maintained over the patterned area.

3. The process of claim 1, additionally including sealing the edges of the device after immersing the device in the wetting agent to prevent the wetting agent from being lost.

4. The process of claim 1, wherein the electrochemical reaction is carried out by positioning electrodes so as to be in contact with the at least one thin metal layer and the electrolyte to provide an electrochemical circuit.

5. The process of claim 1, wherein the wetting agent is alcohol based.

6. The process of claim 1, additionally including selecting the wetting agent from the group consisting of methanol, isopropanol, ethanol, and trichloroethylene.

7. The process of claim 1, additionally including forming the electrolyte from a dilute acid solution.

8. The process of claim 7, wherein the electrolyte is formed from a 4:1 water:sulfuric solution.

9. A process for forming submicron holes in thin metal layers comprising:

providing a device having at least one thin metal layer with a mask having at least one patterned area of holes thereon.

immersing the device in a wetting agent, transferring the wetted device to an electrochemical etching apparatus such that a film of the wetting agent is maintained over the at least one patterned area, sealing the edges of the device to prevent the wetting agent from being lost, providing a quantity of electrolyte on the at least one patterned area wherein the electrolyte replaces the wetting agent in the holes of the patterned area, positioning electrodes so as to be in contact with the at least one thin metal layer and the electrolyte to provide an electrochemical circuit, and exciting the electrochemical circuit causing etching of patterned holes in the at least one thin metal layer.

10. The process of claim 9, additionally including selecting the wetting agent from the group consisting of methanol, ethanol, trichloroethylene, and isopropanol.

11. The process of claim 9, wherein maintaining the wetting agent over the at least one patterned area is carried out by transferring the device in a horizontal position.

12. The process of claim 9, additionally including forming the electrolyte from a 4:1 water:sulfuric solution.

13. The process of claim 9, wherein sealing the edges of the device is carried out by positioning a hollow member having a seal thereon in contact with the patterned mask.

14. The process of claim 13, wherein providing a quantity of electrolyte is carried out by pouring the electrolyte in the hollow member.

15. The process of claim 9, wherein positioning the electrodes is carried out by connecting a work electrode to the thin metal layer, positioning a counter electrode and a reference electrode in the electrolyte, and connecting the electrodes to a controlled electrical power source.

16. The process of claim 15, wherein exciting the electrochemical circuit is carried out by applying at least one pulse of electrical power to the counter electrode.

17. The process of claim 16, wherein the at least one pulse is a +10.2 volt, 100 ms pulse.

18. In a process for producing a device having submicron patterned holes in thin metal layers and having a mask with patterned tracks over the thin metal layers, the improvement comprising:

immersing the device in a wetting agent, and electrochemically etching the submicron patterned holes.

19. The improvement of claim 18, additionally including transferring the device following immersion in the wetting agent in a horizontal position to an electrochemical etching apparatus so as to maintain a film of wetting agent covering the patterned tracks of the mask.

20. The improvement of claim 18, wherein the electrochemically etching is carried out by providing an electrolyte on the patterned tracks of the mask so that the wetting agent in the tracks is replaced by the electrolyte.

21. The improvement of claim 20, wherein providing the electrolyte on the patterned tracks of the mask is carried out by placing a hollow member on the mask for preventing loss of the wetting agent, and pouring the electrolyte into the hollow member.

22. The improvement of claim 21, additionally including providing a sealing member on the hollow member and in contact with the mask.

23. The improvement of claim 20, wherein the electrochemical etching is carried by providing an electrochemical setup of an electrolyte and a device with at least one patterned masked thin metal layer.

24. The improvement of claim 23, wherein providing the electrochemical setup circuit is carried out by connecting a electrode to one of the thin metal layers, placing at least a counter electrode in the electrolyte, and connecting the electrodes to a controlled electrical power source.

25. The improvement of claim 24, additionally including positioning a reference electrode connected to the power source in the electrolyte.

26. The improvement of claim 23, wherein the electrochemical; circuit is activated by at least one pulse of electrical power.

27. The improvement of claim 26, wherein the at least one pulse of electrical power comprises a +10.2 volt, 100 ms pulse, and wherein the electrolyte is a solution composed of 4:1 water:sulfuric.

* * * * *